United States Patent [19]

Merideth

[11] 4,185,487

[45] Jan. 29, 1980

[54] SIDE ACCESS CLEAT FORMER APPARATUS AND METHOD OF USE

[75] Inventor: Dallas L. Merideth, Millstadt, Ill.

[73] Assignee: Engel Industries, Inc, St. Louis, Mo.

[21] Appl. No.: 910,523

[22] Filed: May 30, 1978

[51] Int. Cl.[2] ..... B21D 5/04; B21D 37/08

[52] U.S. Cl. ..... 72/315; 72/320

[58] Field of Search ..... 72/312, 315, 319, 323, 72/381, 411, 320

[56] References Cited

U.S. PATENT DOCUMENTS

| | | | |
|---|---|---|---|
| 2,973,796 | 3/1961 | Engel et al. | 72/315 |
| 3,731,514 | 5/1973 | Deibele, Jr. | 72/411 X |
| 3,994,152 | 11/1976 | Wolters | 72/315 |
| 4,014,200 | 3/1977 | Wolters | 72/315 |

*Primary Examiner*—Michael J. Keenan

[57] ABSTRACT

A cleat-former machine, of the type which utilizes two rotating wipers, permits removal of formed cleats sideward from either end of the bending blade, and can be used with workpieces whose length exceeds that of the wipers. L-shaped side plates, which support between them a bending blade and a wiper arm mechanism adjacent the aft bending edge of the bending blade, have cutouts provided in their upper edges in registration with the ends of the bending edge. A rocker-arm clamping assembly, rotatably mounted on a shaft above and aft of the bending blade, is rotated to clamp and unclamp a sheet metal workpiece relative to the blade by a tilt lever outward of the side plate, aft of the cutout, at their level, and operated off the aft side of a circular cam supported outward of said side plate and rotated by the gear train. Side access to the ends of the blade bending edge is thereby provided. In the method of the present invention, especially useful in fabricating L-shaped duct workpieces, 180° cleats may be formed on the opposite edges of one panel only of a flat workpiece notched to define two panels by aligning the notch with the side edge of the wiper arm mechanism, with the panel not to be cleated projecting outward. A 180° cleat longer than the length of the wiping arm mechanism may be formed by making slits to divide the workpiece edge into separate portions of no greater length than the wiper arm mechanism length and cleating successive portions individually while the yet uncleated portions project outward.

2 Claims, 7 Drawing Figures

6
6
103
93
102
91
11
101
16
94
61
100
109
13
31
30
110
108
84
106
59
14
21
107
80
87
49
51
105
88
120
113
115
130
12
a
b
c
d
e
f 110
107
109
106
100
11
108
47
59
80
88
87
120
62
66
61
60
115
46
51
50
49
94
95
e

SIDE ACCESS CLEAT FORMER APPARATUS AND METHOD OF USE

BACKGROUND OF THE INVENTION

The present invention relates to apparatus for forming cleat edges on sheet metal workpieces and more specifically to such apparatus in which the cleat edge is formed by a pair of wiping arms aft of and below a bending blade. The present invention is particularly addressed to the problem of forming cleat edges on one of the two panels of L-shaped duct sections previous to forming to the L shape, as well as to the problem of forming cleat edges on the side edges of duct pieces of greater length than the wiping arms.

Heretofore, complicated roll forming machines, such as the one shown in U.S. Pat. No. 3,815,398 to McClain, were utilized to perform these operations. With such apparatus, cleat edges could be formed on duct pieces of any desired length, and alternate portions of the workpiece edges could be cleated, leaving intermediate portions uncleated.

U.S. Pat. No. 2,973,796 to C. F. Engel, et al. discloses an apparatus for forming cleat edges on sheet metal workpieces by the use of a pair of wiping arms, one aft of and one beneath a bending blade. The wiping arms, their drive mechanism, and a rocker-arm type clamp for clamping the sheet metal workpiece relative to the bending blade are supported by vertical end plates at both sides of the bending blade. The clamp is driven by a tilt lever mechanism which extends forward at each side of the bending blade to circular tracks on heavy steel discs driven by the drive mechanism. Starting at a gaging position, against which the edge of the workpiece is first presented, the upper wiper arm turns to a clearance position, by which the cleated workpiece may be removed by an aft movement to free it from the bending blade, followed by upward and forward movement to remove the workpiece entirely. The wiper arm is then rotated the remainder of the 360° revolution, returning it to the gaging position. Since the vertical end plates, drive mechanism and tilt lever lie at the ends of the bending blade, no clearance is provided for sideward projection of a workpiece from the wiping mechanism; a flat workpiece of greater length than the distance between the end plates cannot be cleated, nor may a cleat edge be formed on only one portion of a side edge of a workpiece except by first bending it upward at 90° to fit in a space between clamping fingers. Thus, such prior apparatus does not permit insulating the interior surfaces of an L-shaped duct workpiece while flat. U.S. Pat. No. 3,994,152 to Wolters, though in most respects similar to the patent to Engel, discloses a slightly different way of both gaging and providing for removal of cleated workpieces. The cleat is formed during an unhalted 360° revolution of the wiping arm; as it rotates from an initial position an expanding radius wiper arm portion directs the workpiece to be cleated to a gaging position. The cleat edge is then formed by continued rotation to the initial position, which now provides clearance, permitting the cleated workpiece to be removed by the same movements as in the patent to Engel.

SUMMARY OF THE INVENTION

An object of the present invention is to provide a simple cleat former, of the type in which the cleat edge is formed by a pair of wiping arms aft of and below a bending blade, which will form continuous cleats on duct pieces of greater length than the length of the wiping arm mechanism. A further object is to provide such apparatus which will form cleat edges on one panel of two-panel flat workpieces, whereby insulation may be affixed after cleating and before forming into a duct. Still another object is to provide such apparatus which would permit insertion and removal of the workpiece sideward. Still another object is to provide such side access cleat forming apparatus which will optimally perform the cleat-forming operation in a single unhalted 360° revolution of the wiping arm mechanism. Other objects will be apparent from the disclosure which follows.

Briefly summarizing, in the present invention there is provided a work table and a bending blade supported at the level of the work table by an angle connecting a pair of generally L-shaped side plates. Each L-shaped side plate has a lower portion, which supports the bending blade in its upper edge, the upper edge having a cutout of sufficient size outward of the bending blade bending edge to permit removal of a cleat edge sideward. The L-shaped side plates each have an aft portion continuing upward from the lower portion. Between them the side plates support an upper wiping arm aft of and at the level of the bending blade and a lower wiping arm beneath the edge of the bending blade. Outward of one of the side plates, below the upper edge of its lower portion and aft of the forward edge of its aft portion, a powered gear train serves to rotate the upper and lower wiper arms in the same sense at the same speed. A rocker-arm type clamp, supported rotatably on a shaft between the upper aft portions of the side plates, clamps the sheet metal workpiece fixed relative to the bending blade. A generally circular cam having a segment removed, driven by the gear train means, serves to rotate a lever arm fixed to the outer end of the rocker-arm clamp, driving the clamp down to hold the workpiece. The lever arm is so mounted that it is driven off of the aft side of the circular cam and is aft of the cutout at the level of the cutout.

Such apparatus may be utilized in the manufacture of L-shaped duct pieces to form 180° cleats on the opposite edges of one panel only of a flat workpiece previously notched to define two panels. By aligning the notch with one edge of the wiper arm mechanism, clamping the workpiece so aligned, and then performing the steps required to cleat the edge, an edge of one panel only of the two-panel workpiece may be cleated. To cleat the edge on the opposite side of the same panel, the workpiece is reversed, the notch aligned with the other side edge of the wiper arm mechanism, and the cleat forming steps repeated.

By providing a plurality of slits in the edge of a workpiece of greater length than the length of the wiping arm mechanism to divide its edge into edge portions of no greater length than the wiping arm mechanism, such apparatus may be utilized to form a continuous cleat along the entire length of the sheet metal workpiece. The endmost workpiece portion is cleated, by first aligning its slit with one side edge of the wiping arm mechanism such that the remaining portions extend sideward from the apparatus, and then forming the cleat by the conventional steps. To continue cleating the entire workpiece edge, the workpiece is slided sideward, the nonadjacent end of the next separate edge portion is aligned with the same side edge of the wiping arm mechanism, and the cleat edge is formed by the conventional steps. This is repeated until the entire cleat edge desired to be formed is completed.

DESCRIPTION OF THE PREFERRED EMBODIMENT

Figure 1:
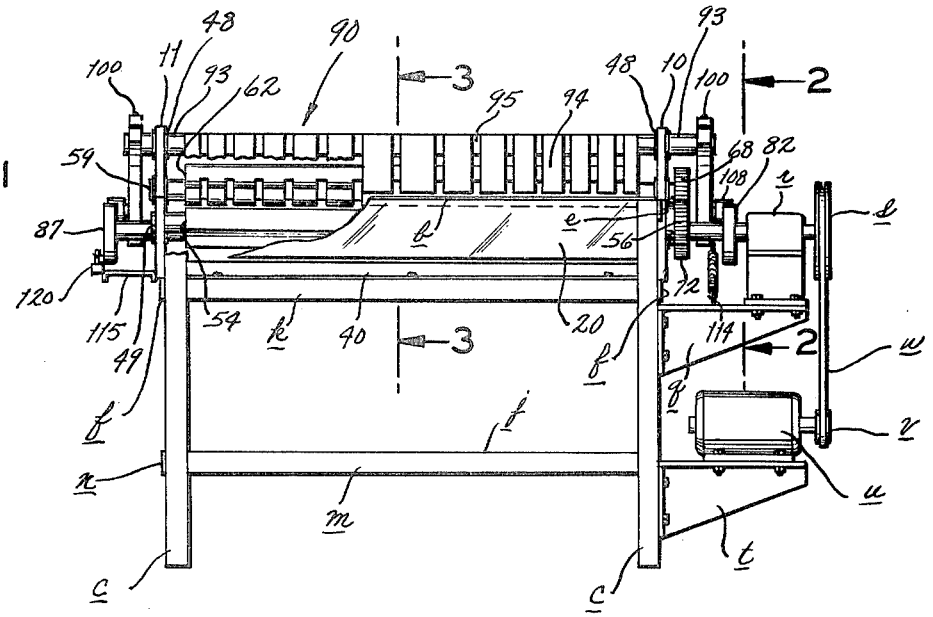
FIG. 1 is a front elevation of a cleat former embodying the present invention, with the work table and clamping fingers partially broken away to reveal the wiping arm mechanism.
Figure 2:
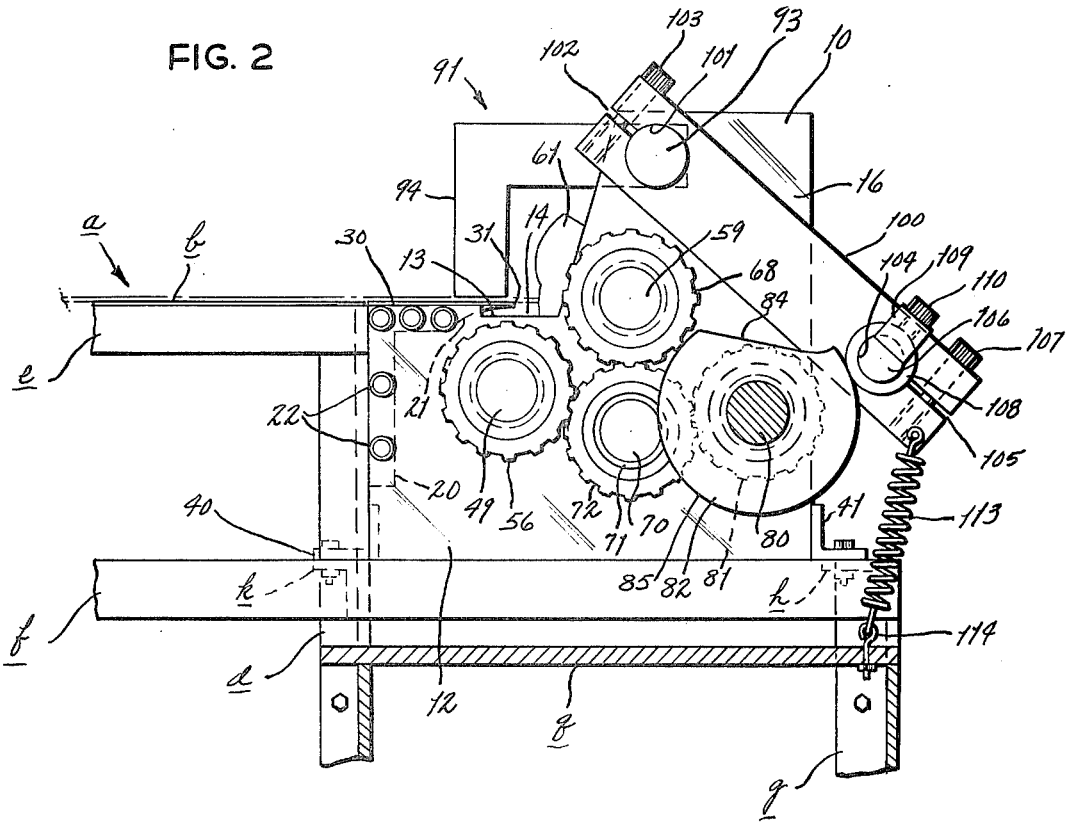
FIG. 2 is an enlarged fragmentary view, partly as seen along line 2—2 at the right side of FIG. 1, immediately after clamping and prior to initial wiping.

In the preferred embodiment of the present cleat-forming machine, a conventional work table a is provided into which the cleat-forming mechanism may be installed, as shown in FIGS. 1 and 2. The work table a has a table top b formed of heavy gauge sheet metal, which establishes a working level and which extends fore and aft between front legs c and intermediate legs d, constructed of metal angles. An upper fore-to-aft tie plate e, one on each side of the work table a, extends from the front legs c to the intermediate legs d, supporting the table top b. Below these upper tie plates e are intermediate fore-to-aft tie plates f extending from the front legs c rearward beyond the intermediate legs d to aft legs g, formed of angles which extend no higher than the intermediate tie plates f. An upper aft cross member h, formed of a metal angle, links the aft legs g at their upper ends, while a lower aft cross tie plate j links them at a lower level. An intermediate upper cross member k, formed of an angle, links the intermediate legs d at the same level as the upper aft cross member h. The frame of the work table a is completed by a lower intermediate cross tie plate m linking the intermediate legs d and lower fore-to-aft tie plate n extending from the front legs c rearward to the aft legs g.

As shown in FIG. 1, mounted on the right side of the work table a between the intermediate and aft legs d, g is an upper speed reducer mount q upon which is mounted a speed reducer r with an outward pulley s. A motor mount t is provided below the speed reducer mount q. An electric motor u is bolted thereto with its pulley v extending outward and aligned with the speed reducer pulley s. The pulleys s, v are linked by a V-belt w. The motor u and speed reducer r serve as the cleat former's power source.

In the preferred embodiment of the present invention, the basic machine structure mounting the elements which perform wiping and clamping operations is a pair of parallel right and left generally L-shaped side plates 10, 11. Each has a forward lower side plate portion 12 whose upper edge 13 is slightly below the level of the table top b, and has a rectangular cutout 14 in sideward registration with the aft edge of a bending blade, to be described below. The cutouts 14 are of sufficient length from front to back and of sufficient depth vertically to provide clearance at both ends of the bending blade for removal of a cleat edge therefrom.

Each L-shaped side plate 10, 11 has an aft side plate portion 16 which continues rearward and upward from the lower side plate portion 12, its edge slanting upward and rearward from the cutout 14 in the lower side plate portion upper edge 13 to the upper edge of the aft portion 16.

Referring to FIG. 2, joining the right and left side plates 10, 11 at their forward ends is a blade support angle 20. One leg of the angle 20 links the forward edges and the other leg links the upper edges of the side plate lower portions 12. That side of the angle which links the side plate upper edges 13 tapers therebeneath along a curve which provides clearance for the lower wiper arm mechanism, to be described below. Stud bolts 22 through the side plates 10, 11 into the ends of the blade support angle 20 hold it in place.

Supported at the working level on the blade support angle 20 is a forming or bending blade 30, shown in FIGS. 2–5, extending rearward from the work table b to a straight rear edge 31. To provide adequate clearance forward of the forward edge of the aft side plate portion 16 for the unformed edges of long sheet metal workpieces, the bending blade rear edge 31 is located forward of the forward edge of the aft side plate portion 16 by a distance measured at the level of the blade 30 greater than twice the width of a cleat edge to be formed. The bending blade 30 is fixed in position on the blade support angle 20 by screws 32.

The right and left side plates 10, 11 are joined by a forward support angle 40 at the lower ends of their forward edges and by an aft support angle 41 at the lower end of their aft edges. On assembly to the work table a, the support angles 40, 41 rest on its cross members h, k.

Aligned bushings 45 are provided in the lower portions 12 of the L-shaped side plates 10, 11 below the cutouts 14 beneath the bending blade rear edge 31. The bushings 45 support between them on an axis parallel to the bending blade rear edge 31 the shaft ends 49 of a lower rotatable wiper arm assembly, generally designated 50, which includes an inner wiper arm 51 having, along its circumference, a full-radius wiping portion 52 and a reduced-radius portion 53. The inner wiper arm 51 terminates in wiper arm side edges 54 inward of the side plates 10, 11, shown in FIGS. 1 and 6. That shaft end 49 which extends rightward has a lower wiper sprocket 56 fixed thereto outward of the side plate 10.

Figure 6:
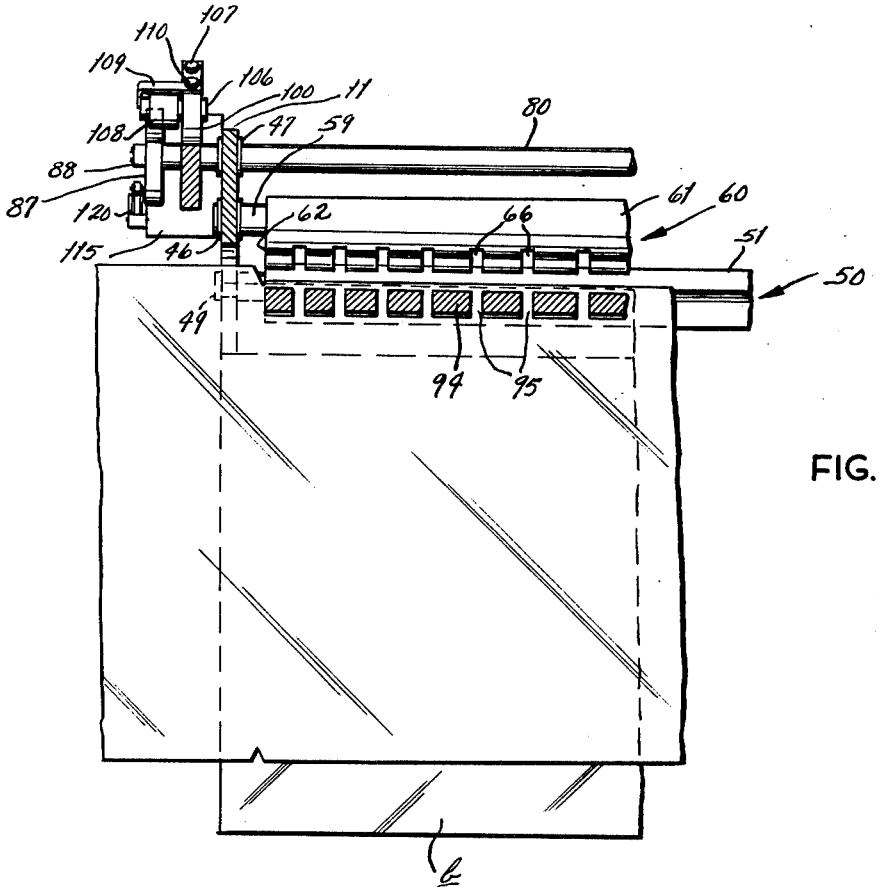
FIG. 6 is an enlarged sectional view taken from above of the left side of the present invention as seen along line 6—6 of FIG. 5. A sheet metal workpiece notched to permit cleating of a portion of the edge, is shown with the cleat formed over the bending blade.

In the aft side plate portions 16 are provided aligned bushings 46, having their centers substantially at the level of the bending blade 30, and serving to mount the shaft ends 59 of an upper or aft rotatable wiper arm assembly, generally designated 60, on an axis parallel to the bending blade rear edge 31. Inward of the side plates 10, 11, the upper wiper arm assembly 60 has an inner wiper arm 61 whose side edges 62 align with the side edges 54 of the lower wiper arm 51, as shown in FIGS. 1 and 6. The inner wiper arm 61 has successively along its circumference a gaging surface portion 64 of constant radius measured from the wiper arm axis of rotation, a wiping portion 63, and a reduced-radius clearance portion 65, best shown in FIG. 3. The wiping and gaging portion 63, 64, have a plurality of spaces of notches 66 spaced along the length of the wiper arm 61, shown in FIGS. 1 and 6, whose use is explained hereafter. Fixed on that shaft end 59 which extends rightward is an upper wiper sprocket 68.

An idler shaft 70 is fixed to the right side plate 10 and extends outward beneath the upper wiper arm shaft 67 slightly below the level of the lower wiper arm shaft 49. Rotatably supported on the bushing 71 on the idler shaft 70 is an idler sprocket 72, engaging the lower wiper sprocket 56 and the upper wiper sprocket 68. The lower wiper sprocket 56, upper wiper sprocket 68 and idler sprocket 72, which make up a gear train, are all of equal diameters, as shown in FIG. 2. Therefore, the lower and upper wiper arms 50, 60 rotate in the same sense at the same speed.

The right and left side plates 10, 11 have bearings 47 aft of the idler shaft 70, slightly below the level of the lower wiper arm shaft 49 and slightly above the level of the idler shaft 70, through which extends a cam shaft 80 perpendicular to the side plates 10, 11. Outward of the right side plate 10 a cam shaft sprocket 81, identical to the above-described sprockets, is fixed on the shaft 80, engaging the gear drive train idler sprocket 72 and, being of the same size as the other sprockets, to be rotated at the same speed as the rotatable wiper arms 50, 60. Outward of the cam shaft sprocket 81 a generally circular cam 82 is keyed to the cam shaft 80 and outward of the cam 82 the shaft 80 is driven by the speed reducer r. The cam 82 has a noncircular portion 84 made by removal of a generally segment-shaped piece, shown in FIG. 2. At one end, the noncircular portion 84 curves outward to meet the remaining circular outer portion of the cam 80, hereinafter referred to as the full-radius portion 85.

Outward of the left side plate 11, fixed on the cam shaft 80, is another cam 87, similar to the right side circular cam 82 and correspondingly numbered. The left side cam 87 has, bolted on its outer surface, a switch block 88 which extends outward to actuate a roller on the lever arm of a limit switch, described below.

Aligned bushings 48 mounted in the aft side plate portion 16 above the level of the uper wiper arm 60 mount, on an axis parallel to the bending blade rear edge 31 in and between the side plate aft portion 6, a rocker-arm type clamp shaft assembly, generally designated 90 which is made up of a clamping mechanism 91 and a pair of tilt levers 100, described below. A clamping mechanism 91 has, inward of the side plates 10, 11, a rectangular bar 92 from which shafts 93 extend outward through the aligned bushings 48. Extending forwardly and down from the rectangular bar 92 are clamp portions comprising L-shaped clamping fingers 94 which project above the bending blade 30. The clamping fingers 94 have spaces 95 therebetween which correspond to and are aligned with the notches 66 in the wiping and gaging portion 63, 64 of the upper wiper arm 60, as shown in FIGS. 1 and 6. These are conventionally used to accommodate an upward-bent sheet metal edge.

The rocker-arm clamp shaft assembly 90 is completed by a pair of tilt levers 100, one mounted on the end of each clamping mechanism shaft 93 outward of the side plates 10, 11. The tilt lever 100 is a rectangular bar having an upper bore 101 at one of its ends engaged on the clamping mechanism shaft 93. A slot 102 extends from the bore 101 to the end of the tilt lever 100, dividing the end into two portions which are pulled together by a stud bolt 103, to clamp the tilt lever 100 tightly to the clamping mechanism shaft 93. The tilt lever 100 is so positioned as to be aft of the side plate cutout 14 at the level of the bending blade 30. At its opposite end, the tilt lever 100 has a lower bore 104, similarly having a slot 105 extending to that end from the bore 104. The lower bore 104 receives a short axle 106, similarly clamped by a stud bolt 107. Each axle 106 supports a roller 108 thereon, aligned with the right and left circular cams 82, 87 and operative from their aft sides. An L-shaped bracket 109, mounted to the side of the tilt lever 100 by a mounting bolt 110, extends outward and downward to the end of the axle 106, retaining the roller 108 thereon.

A tension spring 113, shown in FIG. 2, is connected between the lower end of the right tile lever 100 and an eye bolt 114 in the speed reducer mount q.

Figure 4:
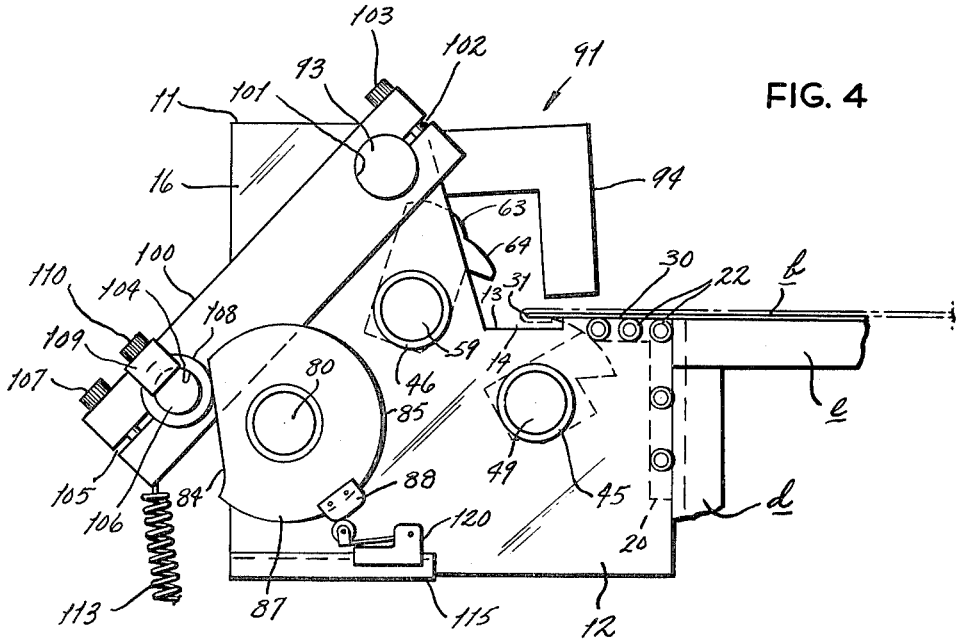
FIG. 4 is a left elevation, otherwise corresponding to FIG. 2, showing the mechanism in the clearance position after forming a cleat, which may be removed either conventionally or endwise.
Figure 5:
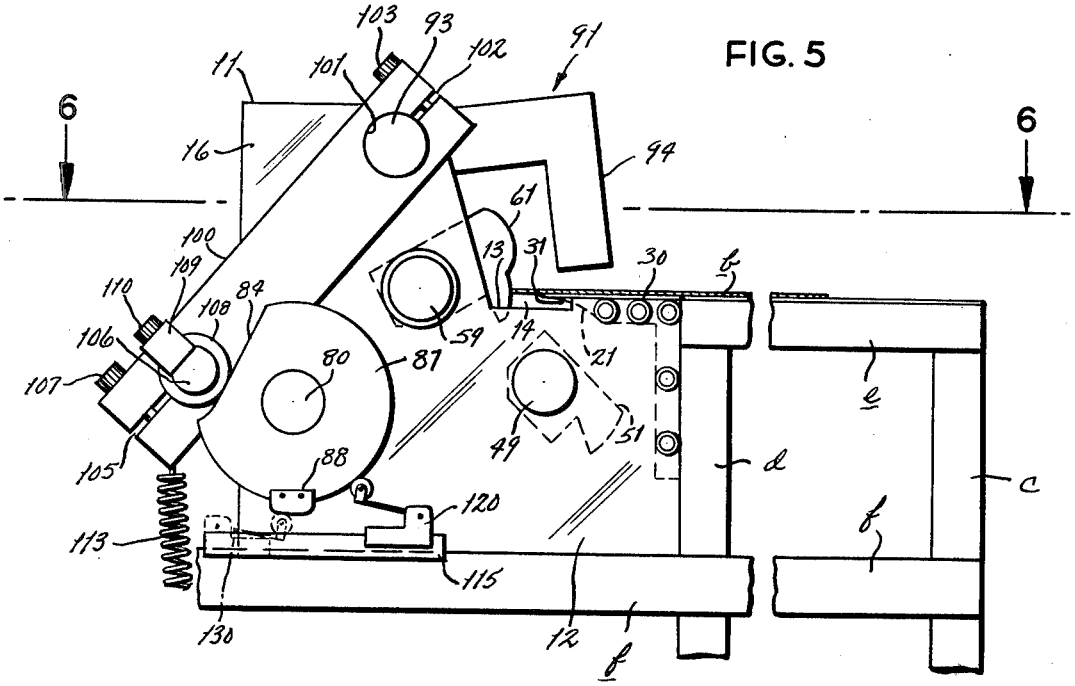
FIG. 5 is a left elevation similar to FIG. 4, showing the mechanism fully rotated back to gaging position, which permits endwise removal. A second microswitch, forming part of a bypass circuit, is shown in phantom lines.

On the outer side of the left side plate 11, at its lower edge, is a mounting channel 115, shown in FIG. 1, extending outwardly nearly to the outer side of the left circular cam 87. As shown in FIGS. 4 and 5, mounted to the outer side of the channel 115 is a first limit switch 120, of the double-pole, single-throw type, having a set of normally open contacts 121 and a set of normally closed contacts 122.

Figure 7:
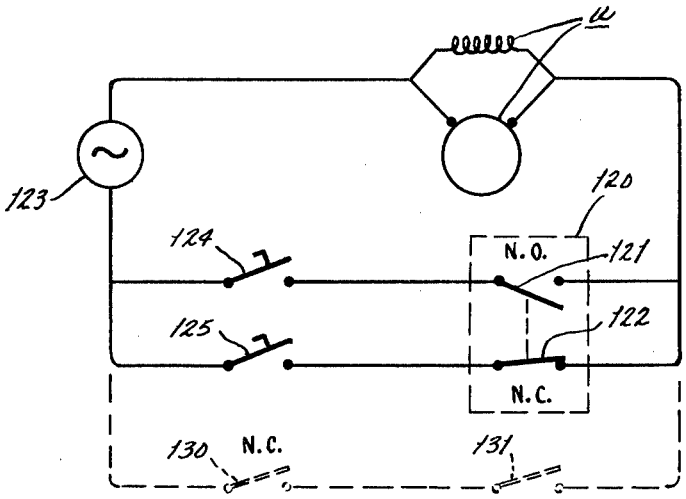
FIG. 7 is a wiring diagram for the present invention with an optional bypass circuit shown in phantom lines.

Referring to the wiring diagram of FIG. 7, the cleat former electrical control circuit comprises an A.C. power supply 123 in series connection with the parallel shunt electric motor u. A first foot switch 124 is in series with the normally open contact 121, while a second foot switch 125 is in series with the normally closed contact 122. These two series combinations, formed control means to start and stop rotation of the mechanism, are both in parallel with the series combination of the electric motor u and the power supply 123.

Construction of the present invention may be apparent to persons skilled in the art from the above description of its structure. Briefly, first the various bearings and bushings are installed in the right and left side plates 10, 11 and the lower wiper arm 50, the upper wiper arm 60 and the cam shaft 80 are put into position therethrough. The blade support angle 20, forward support angle 40 and aft support angle 41 are attached as by bolting to the side plates 10, 11, fixing them in position and the bending blade 30 is screwed to the blade support angle 20. Next the sprockets, 56, 68, 72, 81 are positioned on the shafts 49, 59, 71, 80 and aligned with each other, with care taken that the wiping arms 50, 60 are in proper angular position with respect to one another. The right and left circular cams 82, 87 are next positioned and keyed to their shaft 80 in such angular positions as to properly interact with the tilt levers 100, next to be installed, to produce clamping at the desired position of the wiping arm mechanism. Last, the tilt levers 100 are clamped to the clamping mechanism shaft 93 and the coil spring 113 is installed.

Figure 3:
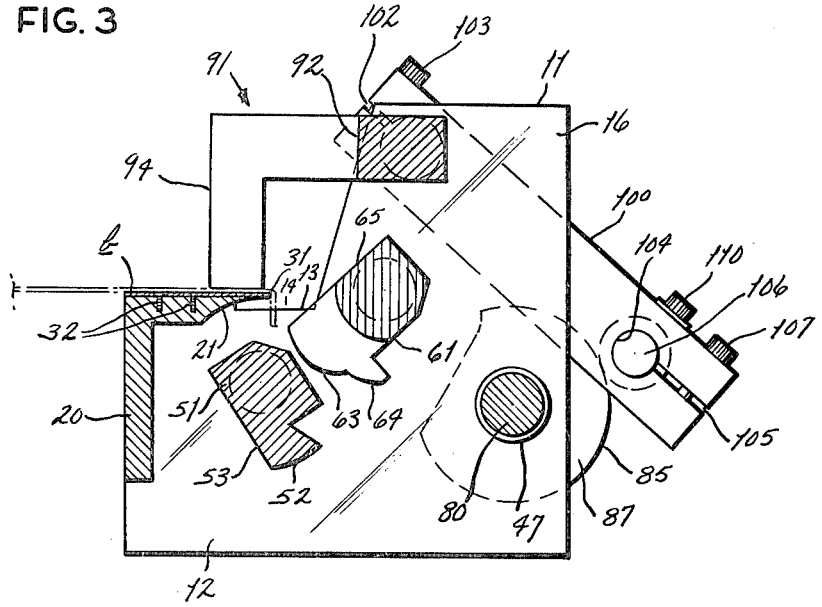
FIG. 3 is a similarly enlarged sectional view taken along line 3—3 of FIG. 1, shown after the edge of the sheet metal workpiece has been wiped downward to 90°.

Using the wiring circuitry in solid lines in FIG. 7, operation of the present cleat former proceeds as follows: in its initial gaging position, the wiping arm mechanism is so rotated that the upper wiper arm gaging portion 64 is adjacent to and aligned with the bending blade straight rear edge 31; the clamping fingers 94 are up, shown in FIG. 5. A sheet metal workpiece upon which a cleat edge is to be formed is pushed into position with that edge abutting the gaging portion 64. The cleat former operator first actuates the mechanism by pressing the second foot switch 125; since the switch block 88 has previously been rotated to a position slightly clockwise from the first limit switch 120, its normally closed contacts 122 are closed and the electric motor u begins to run. The cams 82, 87 rotate; when the full-radius portion 85 reaches the roller 108 on the tilt lever 100, it causes the tilt lever to rock upward so far as to drive the clamping fingers 94 clamping onto the sheet metal workpiece to the bending blade 30, as shown in FIG. 2. As rotation continues, the upper wiper arm wiping portion 63 first wipes the edge of the workpiece downward to approximately 90°, as shown in FIG. 3, and then the lower wiper arm 50 wipes the edge to 180°, about the bending blade 30. When the switch block 88 on the left circular cam 87 next engages the first limit switch 120, its normally closed contacts 125 open, turning off the electric motor u, leaving the upper wiper reduced-radius clearance portion 65 aligned with and adjacent to the bending blade straight rear edge 31 and the tilt lever rollers 108 on the noncircular portions 84 of the circular cams 82, 87, as shown in FIG. 4 and referred to as the clearance position. Thus, the workpiece is no longer clamped and may be removed. After removal, the operator presses the first foot switch 124, referred to as the second actuation, and the upper wiper arm 60 returns to its gaging position.

Removal of the workpiece may be by either of two ways. First, the conventional manner of sliding the workpiece aft until the 180° cleat clears the straight rear edge 31 and then moving the workpiece upward and forward may be utilized. Second, sideward removal is possible by sliding the workpiece sideward until the cleat edge is free of the bending blade 30. The present invention makes possible this method of removal by use of the L-shaped side plates 10, 11 with cutouts 14, the aft placement of the tilt levers 100 to operate from the aft side of the circular cams 82, 87, and placement of the gear train aft of the forward edge of the side plates.

The above embodiment and its equivalents lend themselves to a new method of manufacturing L-shaped duct pieces, in which it is necessary to form cleats on the opposite edges of the panel to be cleated of a flat workpiece notched to define two panels, as shown in FIG. 6, but not yet bent along the line indicated by such notches. First, the workpiece is positioned with one of the panel edges to be cleated extending over the end of the bending blade 30 a distance substantially equal to the depth of the cleat to be formed plus a bend allowance, which distance may be measured simply by pushing the workpiece against the adjacent gaging portion 64 of the upper wiper arm 60. The notch on the panel edge is aligned with one side edge of the wiper arm so that the panel not to be cleated projects outward from the side edge. This is followed by the steps of clamping the workpiece, so positioned and so aligned, to the bending blade, wiping the edge extending over the bending blade 30 downward to 90° angle by rotation of the first wiper arm, wiping the edge to a 180° angle by rotation of the second wiper arm, and unclamping the workpiece. Thereafter, the workpiece is removed and positioned with the other of such panel opposite edges extending over the bending blade straight rear edge 31 a distance substantially equal to the depth of the cleat to be formed plus a bend allowance, which, in use of the above-described embodiment, may be measured by pressing against the upper wiper arm gaging portion 64. The notch which defines the junction of the two panels is so aligned with the other side edge 62 of the upper wiper arm 60 that the panel not to be cleated projects outward from the side edge 62. Last, the steps of clamping, wiping to 90°, wiping to 180° and unclamping are performed. Thus, a cleat is formed without previously forming a 90° bend between the panel to be cleated and the panel not to be cleated.

The present cleat former and equivalents may also be utilized in a new method of forming on a sheet metal workpiece a 180° cleat edge longer than the length of the wiping arm mechanism. First, the workpiece edge is divided in separate edge portions by providing a plurality of spaced-apart slits in its edge to be cleated to a depth substantially equal to the depth of the cleat plus a bend allowance, similar to the notches shown in FIG. 6. Thus, the end of each separate portion comprises either an end of the workpiece or a slit; the length of each of the separate portions is no greater than the length of the wiping arm mechanism. Next, the workpiece is inserted into the cleat former with a portion commencing with one end of the workpiece positioned on the bending blade, extending over its straight rear edge 31 a distance substantially equal to the depth of the cleat to be formed plus a bend allowance, measured in the above embodiment by the upper wiper arm gaging portion 64. The slit which forms the inserted endmost workpiece separate portion is aligned with one side edge 62 of the wiper arm 60 such that the endmost portion is adjacent to the wiping arm mechanism. A cleat edge is formed on that portion by the conventional steps of clamping the workpiece, so positioned and aligned, relative to the bending blade, wiping the edge extending over the bending blade downward to substantially a 90° angle by rotation of the upper arm, wiping that same edge to a 180° angle by rotation of a lower wiper arm, and unclamping the workpiece. Next, the workpiece is slided sideward so that its advancing end projects through the side plate cutout 14 and a nonadjacent end of the next separate edge portion is aligned with the same side edge of the wiping arm mechanism. Again, a cleat edge is formed on this next separate edge portion by the above-described steps. The steps of moving sideward, aligning and forming a cleat edge are repeated thereafter until any successive separate edge portions are cleated.

If, after the cleat edge has been formed about the bending blade 30, the sheet metal workpiece is to be removed sideward by sliding over the open end of the blade 30, through either of the cutouts 14, halting the wiping arm mechanism in the clearance position is not necessary. The sheet metal workpiece may be removed sideward, even though the wiping arm mechanism has been rotated directly to the gaging position. This is accomplished by the phantom line circuitry of FIG. 7, which adds a bypass circuit including a second limit switch 130, normally closed, mounted on the mounting channel 115 aft of the first limit switch 120 by a distance substantially equal to the circumferential length of the switch block 88, as shown in phantom lines in FIG. 5. The second limit switch 130 is in series combination with a manual switch 131, which series combination is in parallel with the series combination of the electric motor u and A.C. power supply 123.

Closing of the manual switch 131 serves to bring this optional bypass circuit into operation. In its use, the manual switch 131 is closed while the wiping arm mechanism is at its gaging position, at which point the normally closed contacts of the second limit switch 130 are open while the normally closed contacts 122 of the first limit switch 120 are closed, as shown in FIG. 5. To actuate the mechanism, the second foot switch 125 is pressed momentarily until the second limit switch 130 is no longer actuated by the switch block 88 and closes. The mechanism then continues to rotate without either foot switch 124, 125 being pressed until the second limit switch 130 is again actuated by the switch block 88, at which time the second limit switch 130 opens and the electric motor u stops. The mechanism has returned to the gaging position, as shown in FIG. 5.

Other modifications of the present preferred embodiment will be apparent. For example, a single circular cam mounted on either side, with a corresponding single tilt lever, could be utilized to operate the rocker-arm clamp shaft assembly. Any releasable means to clamp the sheet metal workpiece fixed relative to the bending blade may be utilized. Means, operative between the power gear train and a clamping means, aft of the clearance portion provided sideward of the bending blade, which operates the releasable clamp in timed sequence with the rotation of the wiping mechanism, will perform the desired function. Other forms of switching mechanisms to achieve the timed sequence might be substituted. These and other modifications, from the above disclosure, will suggest themselves to those skilled in the art.

I claim:

1. Side access apparatus for forming cleat edges on sheet metal workpieces, being of the type comprising a work table by which a working level is established, a forming blade having a straight rear edge supported at said working level by a pair of side plates, aligned bushing means in said side plates at a level below the edge of said blade and a lower rotatable wiper supported therein, second aligned bushing means supported by said side plates at substantially the level of said forming blade and an aft rotatable wiper supported thereon, aligned bearing means supported by said side plates at a substantially higher level than said forming blade and a rocker-arm type clamp shaft assembly supported therein, said assembly having clamp portions extending forwardly and down, whereby to permit clamping of a sheet metal workpiece relative to said forming blade, and having a tilt lever whereby to rock said assembly to a clamped position, and gear train means connecting a power source to the said rotatable wipers, whereby to rotate them in the same sense at the same speed, characterized in that each said side plate is generally L-shaped and comprises a side plate lower portion having means at its upper edge to support an end of said blade, said lower portion having in its upper edge a cutout in sideward registration with the rear edge of said forming blade, and an aft portion continuing from said lower portion and extending upward thereof spacedly beyond the said forming blade, further characterized in that at least one of said side plates has a shaft aft of said rocker-arm bearing means engaged to said drive train and mounting a generally circular center-mounted cam having a removed generally segment shaped portion, and in that said tilt lever extends generally rearward and downward and has a cam follower operatively bearing against the aft side of said cam outer surface, and further has a return spring, whereby bearing of the cam follower against the circular outer surface portion of the cam rocks the clamp shaft assembly for clamping, and its bearing against the removed segment shaped portion releases such clamping, thereby permitting side access through the side plate cutouts for inserting and removing such workpieces.

2. Side access apparatus for forming cleat edges on sheet metal workpieces, comprising table-like means to establish a working level, a bending blade having a straight rear edge and means to support same at said working level and to provide clearance at both ends of said bending blade for removal sideward therefrom of a sheet metal cleat edge formed therefor, lower wiper arm means beneath and aligned parallel to the rear edge of said bending blade and means to support same rotatably, upper wiper arm means aft of and aligned parallel to said straight rear edge and means to support same rotatably, said upper wiper arm means having successively a gaging portion, a wiping portion and a clearance portion, whereby such clearance portion permits aft and upward removal of a workpiece having a 180° cleat formed over said bending blade, powered gear train means to rotate said upper and lower wiper arm means in the same sense and at the same speed, control means to start and stop such rotation, releasable means to clamp such a sheet metal workpiece at said working level and projecting over said bending blade, means, operative between said powered gear train means and said clamping means and positioned aft of the clearance so provided at the ends of said bending blade, to operate said releasable means in timed sequence with the rotation of said wiper arm means, and electrical control circuit means normally to cause, by a first actuation, angular rotation of said aft wiper arm means first from a position at which said gaging portion is aligned with said bending blade to a position at which said clearance portion is aligned therewith, and by a second actuation, to cause said rotation to said gaging position, said control circuit means including bypass circuit means to avoid stopping rotation at said clearance position, whereby a single actuation effects rotation through 360° from and to the gaging position without stopping at the clearance position, and a cleat edge so formed may be removed by sliding sideward from said bending blade.

* * * * *

UNITED STATES PATENT AND TRADEMARK OFFICE

CERTIFICATE OF CORRECTION

PATENT NO. : 4,185,487

DATED : Jan. 29, 1980

INVENTOR(S) : Dallas L. Merideth

It is certified that error appears in the above-identified patent and that said Letters Patent are hereby corrected as shown below:

In column 5, line 52, delete "6" and insert in its place ---16---.

In column 6, line 21, delete "tile" and insert in its place ---tilt---.

In column 6, line 37, delete "formed" and insert in its place ---forming---.

In column 7, line 11, after "94" delete "clamping" and insert in its place ---clampingly---.

In column 8, line 36, after "upper" insert ---wiper---.

Signed and Sealed this

*Sixth* Day of *May 1980*

[SEAL]

*Attest:*

SIDNEY A. DIAMOND

*Attesting Officer*

*Commissioner of Patents and Trademarks*